United States Patent [19]

Herdeg et al.

[11] Patent Number: 4,704,974

[45] Date of Patent: Nov. 10, 1987

[54] AUTOMATIC SEWING MACHINE SYSTEM

[75] Inventors: Donald F. Herdeg, So. Hamilton, Mass.; Bruce A. Poirier, Windham, N.H.

[73] Assignee: USM Corp., Flemington, N.J.

[21] Appl. No.: 900,022

[22] Filed: Aug. 25, 1986

[51] Int. Cl.[4] ..... D05B 21/00

[52] U.S. Cl. ..... 112/121.12; 112/445; 112/458

[58] Field of Search ..... 112/445, 444, 456, 457, 112/458, 453, 454, 462, 121.12, 121.11, 121.15

[56] References Cited

U.S. PATENT DOCUMENTS 4,270,472 6/1981 Suzuki et al. ..... 112/462 X
4,292,905 10/1981 Widmer ..... 112/121.11
4,413,574 11/1983 Hirota et al. ..... 112/458 X
4,479,446 10/1984 Johnson et al. ..... 112/121.12
4,510,875 4/1985 Peck ..... 112/121.12
4,512,271 4/1985 Herdeg et al. ..... 112/121.12 X
4,548,142 10/1985 Peck ..... 112/121.12

*Primary Examiner*—Peter Nerbun

[57] ABSTRACT

A system is disclosed for selectively assigning stitch patterns that are to be automatically sewn by a sewing machine. The system displays size information relative to stitch patterns which may be sewn by the sewing machine. The operator selects a displayed size from the thus displayed size information. This system is operative to identify a stored stitch pattern which corresponds to the selected size. The thus identified stitch pattern may be thereafter automatically sewn each time a workpiece of that size is presented to the sewing machine.

31 Claims, 9 Drawing Figures

B
210
TRANSMIT MESSAGE "P___" TO DISPLAY 64
SET N=0
212
INCREMENT "N" BY 1
214
216
IS N > 3 ?
YES
A
NO
SET K=1
218
220
IS D PAL(K)=N ?
YES
226
IS D MIN SIZE(K) =0 ?
NO
YES
228
IS D MIN SIZE(K) =0 ?
NO
YES
230
TRANSMIT CURRENT VALUE OF "N" FOR INSERTION INTO NEXT AVAILABLE BLANK SPACE FOLLOWING THE CHARACTER "P" IN THE MESSAGE GENERATED IN STEP 210
INCREMENT "K" BY 1
222
IS K > 32 ?
NO
YES
224

Fig. 4

| DIRECTORY INDEX | D PAL | D MIN SIZE | D MAX SIZE | D FILE CAPACITY | D FILE ADDRESS |
|---|---|---|---|---|---|
| 0 | 0 | 0 | 0 | 0 | 0 |
| 1 | 1 | 5 | 6.5 | 956 | 0 |
| 2 | 1 | 7 | 8 | 1,002 | 956 |
| 3 | 2 | 8.5 | 9.5 | 1,056 | 1,958 |
| 4 | 2 | 10 | 11 | 0 | 3,014 |
| 5 | 3 | 11.5 | 12 | 1,280 | 3,014 |
| | | | | | |
| | | | | | |

AUTOMATIC SEWING MACHINE SYSTEM

FIELD OF THE INVENTION

This invention relates to the automatic sewing of different stitch patterns on identifiable workpieces within an automatic sewing machine system. In particular, this invention relates to the manner in which different stitch patterns are selected in such a system.

BACKGROUND OF THE INVENTION

U.S. Pat. No. 4,479,446, entitled "Sewing Machine System Having Automatic Identification and Processing of Mounted Work", issuing on Oct. 30, 1984, discloses a system for processing work mounted within coded pallets. The system identifies the coded pallets by optically sensing encodings appearing on the pallets. The system furthermore allows the operator to assign a particular stitch pattern to each thus identified pallet. This stitch pattern will thereafter be automatically sewn each time the particular pallet code is sensed by the system.

The assignment of a particular stitch pattern is facilitated through certain interactive communications between the system and the operator. These include a request by the system for the operator to make a stitch pattern assignment in the event that a particularly coded pallet is presented to the system for the first time. The operator must thereafter identify a stitch pattern to the system by typing in a two digit number. The system checks to see if the number is meaningful or valid before accepting the particular numerical assignment. The system thereafter uses the numerical assignment to access the stored instructions defining the stitch pattern. These instructions are preferably stored in a randomly addressable memory.

It is to be appreciated that the above described system is only as good as an operator's ability to use the abstract numbering system which identifies stitch patterns. This will at the least require specific knowledge by the operator as to which stored stitch pattern number is to be selected for each identified piece of work held within a coded pallet.

It would be preferable if the operator were able to simply identify a particular piece of work within a pallet according to his or her own frame of reference and to have the system perform the necessary correlation of this identification to the stitch patterns stored in memory. In this regard, most sewing machine operators in the apparel and shoe manufacturing businesses are accustomed to identifying work in process by a size numbering system. For instance, the machine operator would normally recognize a size fifteen shirt or a size seven and one-half shoe. It would hence be preferable if such a numbering system could be used by the operator in assigning stitch patterns.

OBJECTS OF THE INVENTION

It is an object of the invention to provide a sewing machine system with a communication interface that allows the operator to easily select the appropriate stitch pattern that is to be sewn on a particular workpiece.

It is another object of the invention to provide a sewing machine system with a communication interface that allows the operator to select the appropriate stitch pattern by using a well understood scheme for identifying the work in process.

It is still another object of the invention to provide a sewing machine system which is capable of assigning an appropriate stitch pattern stored in memory in response to certain size information having been transmitted by the operator.

SUMMARY OF THE INVENTION

The above and other objects of the present invention are achieved by an automatic sewing machine system which first reads a code appearing on a pallet and thereafter checks to see whether a stored stitch pattern has been assigned to the thus read pallet code. If a stitch pattern has not been assigned, the system informs the operator that a stitch pattern should be selected on the basis of the operator's knowledge as to the size of the workpiece being held within the coded pallet. The size selection is accomplished by the operator depressing certain switches on the control panel which initiate searches of information relating to the stored stitch patterns. This information includes which stitch patterns may be used with given pallet codes as well as what sizes of a workpiece may be stitched by a given stitch pattern. Size information for a given stitch pattern that may be run for the particularly coded pallet is thereafter incrementally displayed in a manner which allows the operator to respond to the displayed sizes. The operator elects an appropriately displayed size by releasing the depressed switch. In the event that all possible displayed sizes for a given stitch pattern are not deemed suitable by the operator, then the system will automatically move to the next stitch pattern that may be run for the coded pallet. Sizes for this stitch pattern will be incrementally displayed until such time as the operator signifies acceptance of one of the displayed sizes. In this manner, the operator is allowed to select the appropriate stitch pattern without having a need to know anything more than the size of the workpiece within the coded pallet.

The thus selected stitch pattern will be executed by the sewing machine system each time the coded pallet is presented to the system. Before execution, the operator will be given an opportunity to signal his or her continued acceptance of the previously selected size by depressing a start switch on the control panel. In the event that a different workpiece size is to be processed, the operator can merely revert to an incremental display of sizes for stitch patterns that may be used with the particularly coded pallet. In this manner, the operator may either be selecting the same stitch pattern or a different stitch pattern depending on where the incremental displaying of sizes is stopped.

The above described sewing machine system may include an automatic processing of the coded pallets. This automatic processing would be implemented following depression of the start switch. The selected stitch pattern would thereafter be automatically sewn on the processed pallet.

In accordance with another aspect of the invention, a survey is automatically conducted of all stitch patterns relating to each particular pallet code when no pallet has been presented to the system. Pallet codes having at least one stored stitch pattern that may be assigned are displayed to the operator. The operator is thus warned in advance of any particular pallet code that does not have a stored stitch pattern that may be assigned.

BRIEF DESCRIPTION OF THE DRAWINGS

The above and other features of the invention will now be described with reference to the accompanying drawings, in which:

FIG. 4 illustrates exemplary data which may be utilized by the program of FIG. 3*a*–3*f*.

DESCRIPTION OF THE PREFERRED EMBODIMENT

Figure 1:
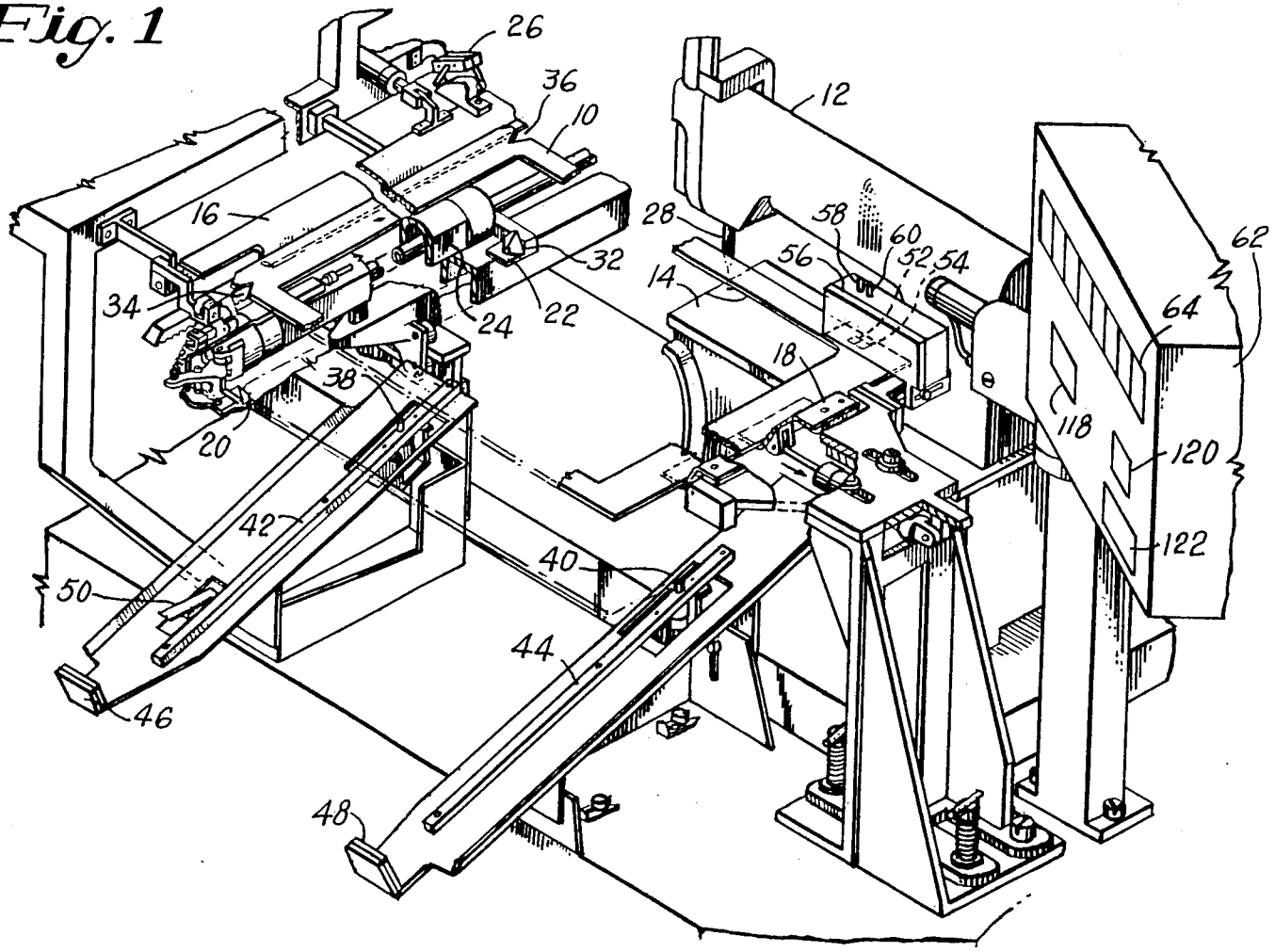
FIG. 1 is an overall perspective view of an automatic sewing machine system having apparatus for processing pallets to and from a sewing machine.

Referring to FIG. 1 an automatic sewing machine system having apparatus for processing a pallet 10 with respect to an automatic sewing machine 12 is generally shown. The pallet 10 is suspended above a bed 14 of the sewing machine by a pair of rotatable shelves 16 and 18. The left edge of the pallet 10 is first dropped by a downward rotation of the shelf 16. The thus dropped edge will come to rest on a pair of support tabs 20 and 22 associated with a moveable carriage 24 that has been previously positioned underneath the shelf 16. A sensor switch 26 detects the downward motion of the shelf 20 so as to thereafter trigger the downward motion of the shelf 18. The right edge of the pallet 10 now drops down to the bed 14 of the sewing machine. This causes the pallet 10 to assume a substantially horizontal position relative to a reciprocating sewing needle 28. Once the pallet 10 has assumed this position, it is clamped between a pair of wedges 30 and 32 which engage a pair of notches 34 and 36 in the pallet 10. The thus clamped pallet is positioned by the moveable carriage 24 relative to the reciprocating sewing needle 28. A workpiece held within the pallet will have a particular stitch pattern sewn thereon. Following completion of the automatic sewing, the carriage 24 is returned to a position underneath the shelf 16. At this point, the wedge 30 is disengaged from the notch 34 and the support tab 20 is rotated outwardly so as to no longer support the front edge of the pallet 10. The front of the pallet 10 now drops onto a pair of shock absorbing pins 38 and 40 which absorb the free fall impact of the front portion of the pallet. The pallet thereafter descends down a pair of slides 42 and 44 and comes to rest against abutments 46 and 48. A contact switch 50 senses the presence of the thus dropped pallet.

The shelves 16 and 18 will have been previously rotated back to their original positions for receipt of another pallet at the thus defined input location. This further pallet will be dropped to the moveable carriage 24 for automatic sewing. The pallet containing the sewn workpiece will thereafter be dropped to the output location defined by the slides 42 and 44 if the sensor switch 50 indicates that the previously dropped pallet has been removed. The above described processing of pallets from an input location to a sewing location and hence to an output location is further addressed in U.S. patent application Ser. No. 873,739, entitled, "Sewing Machine System Having Automatic Processing of Sewn Work", filed in the names of Donald F. Herdeg and Lawrence P. Ciccia on June 12, 1986.

The pallet 10 is seen to include a pair of encodings 52 and 54 located underneath an optical sensor device 56. The encodings are preferably adhesive backed materials which are either reflective or opaque. These encodings are sensed by a pair of optical sensors within the optical sensing device 56. Each optical sensor senses the amount of reflected light from a respective encoding. In accordance with the preferred embodiment of the invention, an optical sensor reading an opaque encoding will produce a binary one signal condition on an output line associated therewith. An optical sensor device which senses a reflective encoding will produce a binary zero signal condition on its output line. These possible signal conditions appear on a pair of output lines 58 and 60 which connect to a system illustrated in FIG. 2. This system attaches particular significance to the aforementioned binary values as will be explained in detail hereafter. For the present, it is merely to be noted that the condition where both optical sensors do not sense reflected light so as to thereby produce binary one values is reserved for no pallet being present under the pallet sensor device 56. It is to be appreciated that various optical sensors may be used to produce the above results. An example of such an optical sensor device is disclosed in U.S. patent application Ser. No. 858,415, entitled, "Optical Sensor for Automatic Sewing Machine", filed Apr. 29, 1986.

A control panel 62 is also associated with the sewing machine system in FIG. 1. The control panel 62 includes an alphanumeric display 64 as well as various touch sensitive switches which can be depressed by an operator. As will be explained in detail hereinafter, the operator selects appropriate stitch patterns that are to be sewn on workpieces contained within pallets such as the coded pallet 10. The operator's selection is premised on a display of numerical sizes for particular stitch patterns that may be executed on a workpiece within a particular coded pallet. The coded pallet must be placed on the shelves 16 and 18 in such a manner that the encodings register with the optical sensor device 56 before the selection process can begin.

Figure 2:
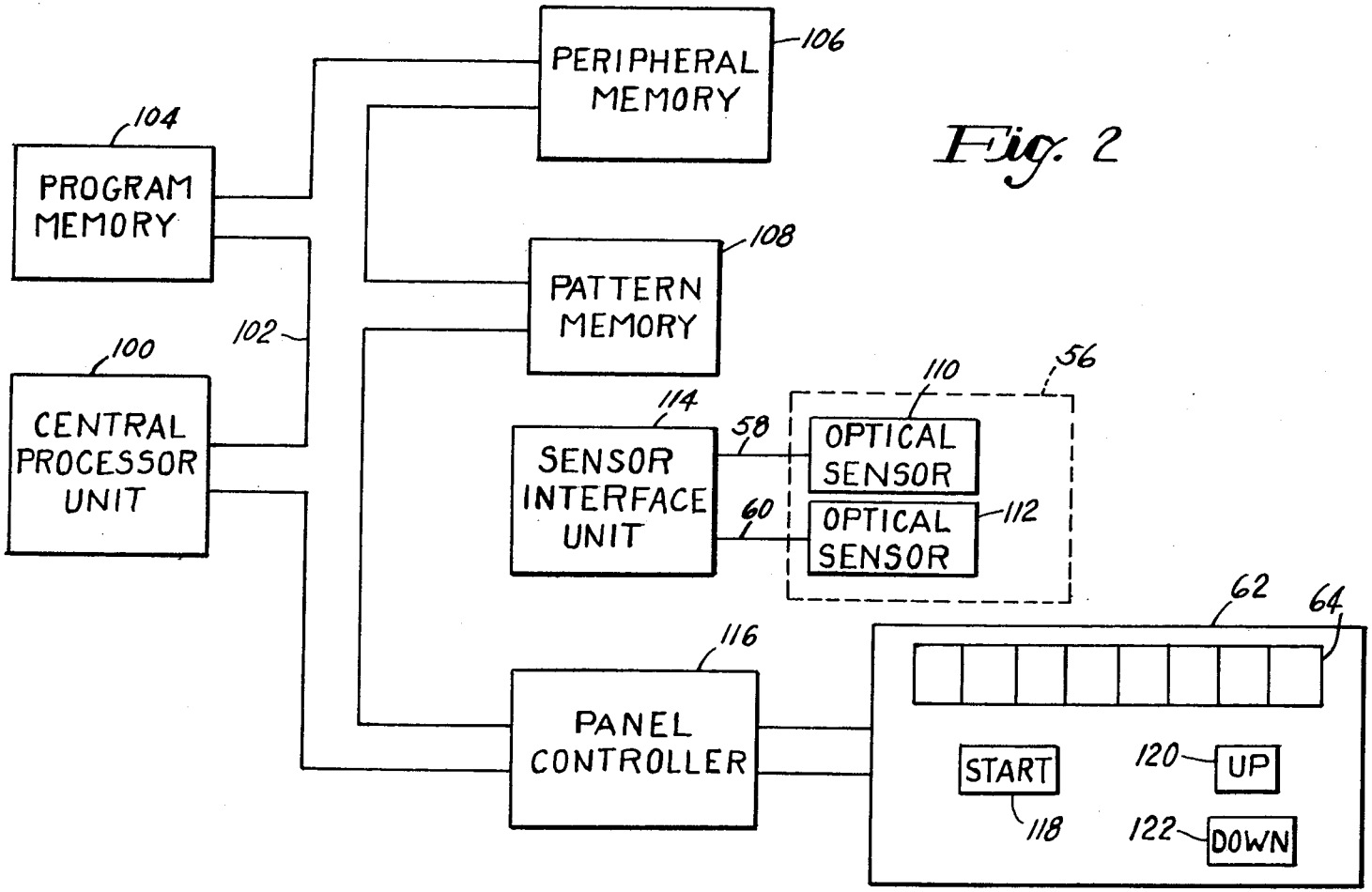
FIG. 2 is a block diagram of a system which assigns stitch patterns to workpieces located within the pallets processed in FIG. 1.

Referring to FIG. 2, an interactive system responsive to the aforementioned operator activities is illustrated. The system includes a programmed central processor unit 100 which is connected by an address and data bus 102 to a number of addressable devices. In accordance with the invention, the central processor unit 100 executes a program stored in a program memory 104. The details of the particular stored program will be explained in detail hereinafter. The central processor unit is furthermore connected to a peripheral memory 106 and a pattern memory 108. The central processor unit 100 is operative to address and read information stored in the peripheral memory 104 or the program memory 104 via the address and data bus 102. The central processor unit is also operative to read the binary values of a pair of optical sensors 110 and 112 within the sensor device 56. This is accomplished by appropriately addressing a sensor interface unit 114 which is connected to the optical sensors 110 and 112 via the lines 58 and 60. The central processor is also connected to a panel controller 116 which controls the alphanumeric display 64 and also provides the status of various control panel switches. In this regard, the panel controller is operative to produce up to eight separately displayed alphanumeric characters for the display 64. The panel controller 116 furthermore provides the status of a "START" switch 118, an "UP" switch 120 and a "DOWN" switch 122. It is to be appreciated that the configuration illustrated in FIG. 2 may consist of any number of well known digital interface circuits connected to an appropriate microprocessor unit.

Referring to the pattern memory 108, it is to be understood that this memory may contain up to thirty two individual stitch pattern files. Each stitch pattern file will have a beginning addressable storage location wherein information relative to that stitch pattern file begins. Each stitch pattern file will furthermore consist of a particular number of addressable storage locations containing all stitch pattern information relating to that particular stitch pattern file. This information generally includes instructions for moving the carriage 24 so as to thereby position a workpiece within a pallet. The instructions are merely accessed from the addressable storage locations within the pattern memory 108 when it is desired to execute the particular stitch pattern on the workpiece located within the pallet 10.

Figure 3A:
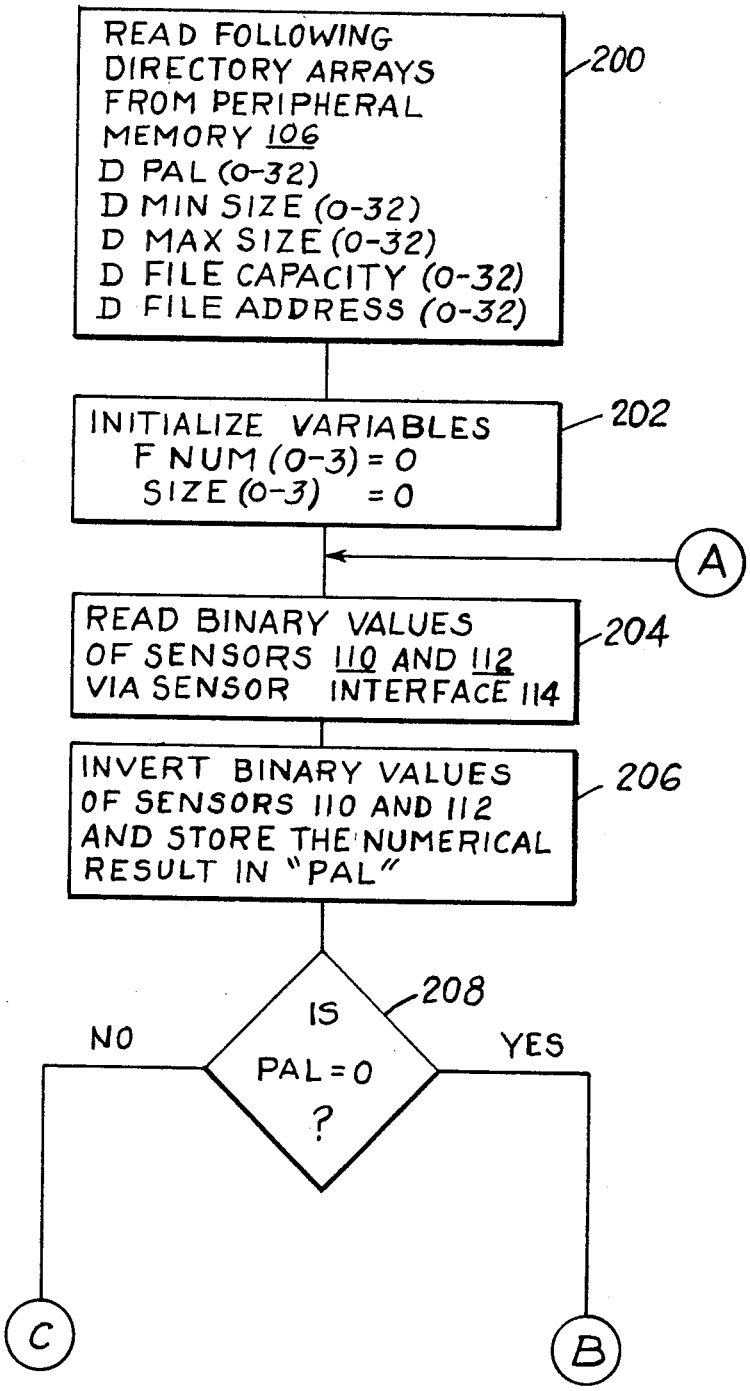
FIGS. 3*a*–3*f* illustrate the programmed flow of computer commands through the system of FIG. 2.

Referring now to FIG. 3*a*, the beginning portion of the program resident in the program memory 104 is illustrated. This program begins with a step 200 wherein a number of directory arrays are read from the peripheral memory 106. Each directory array consists of thirty three separately indexed matrix elements numbered zero to thirty two. The index number zero defines a first element in each array. These zero indexed elements are used to define an initial set of conditions within the program. Each of the index numbers one to thirty two define a stitch pattern parameter for a correspondingly numbered stitch pattern file located in the pattern memory 108. For instance, the D PAL array elements numbered one to thirty two each define a pallet code for a correspondingly numbered stitch pattern file. The D MIN SIZE array elements numbered one to thirty two each define the minimum size of workpiece that may have the particular stitch pattern file sewn thereon. The D MAX SIZE array elements numbered one to thirty two each define the maximum size of workpiece that may have the correspondingly numbered stitch pattern file sewn thereon. The D FILE CAPACITY array elements numbered one to thirty two each define the number of storage locations within the pattern memory 108 occupied by the correspondingly numbered stitch pattern file. The D FILE ADDRESS array elements numbered one to thirty two each define the beginning address for the correspondingly numbered stitch pattern file within the pattern memory 108. Referring to FIG. 4, an illustration of various possible values of the directory array elements is particularly illustrated. In this regard, the directory values for the directory index of one indicate a pallet code of 1, a minimum size of 5, a maximum size of 6.5, a stitch pattern file capacity of 956 and a stitch pattern file address of zero within the pattern memory 108. All of these values define parameters for the stitch pattern file number one within pattern memory 108. On the other hand, stitch pattern file number 3 requires a pallet having a pallet code of 2 containing a workpiece within the size range of 8.5 to 9.5. This file begins at addressable location 1,958 and occupies 1,056 storage locations. It is to be noted that the size ranges for the numbered stitch pattern files in FIG. 4 are arranged in ascending order so that the lowest size range is associated with the lowest file number. This will result in an ordered display of size ranges by the system as will become apparent hereinafter.

Referring again to FIG. 3*a*, the central processor proceeds to a step 202 following the loading of the directory arrays in step 200. The central processor unit now initializes certain variables used by the program to keep track of the state of the sewing machine system. These variables are expressed as two separately named arrays, F NUM and SIZE, each having four indexed variables therein numbered 0–3. The index number zero defines a variable within each array that has been reserved for the condition when no pallet code is being sensed. The index numbers one to three define variables within a given array corresponding to particular numerical pallet codes. In this manner, the value of each such indexed variable element within the F NUM variable array will define a particular file number that is to be executed by the sewing machine when the correspondingly numbered pallet code is detected by the system of FIG. 2. In the same manner, each such indexed variable element within the SIZE array defines the size of workpiece that is to be present within the pallet that is to be processed.

Having initialized the aforementioned program variables, the central processor proceeds to a step 204 and reads the binary values of sensors 110 and 112 via the sensor interface 114. This is accomplished by addressing the sensor interface 114 and reading the stored values within the addressable sensor interface 114. The thus read binary values are inverted in a step 206 and the numerical result is stored in a software variable PAL. It will be remembered that the optical sensors produce binary one values on the lines 58 and 60 when no pallet is present. Since these binary values are inverted in step 206, a numerical result of zero will be stored in PAL so as to indicate no pallet is present within the sewing machine system. The presence or absence of a pallet is noted in a step 208 wherein the stored numerical value in PAL is compared with zero. In the event that no pallet is present, the central processor proceeds along a yes path to a node B in FIG. 3*b*.

Figure 3B:
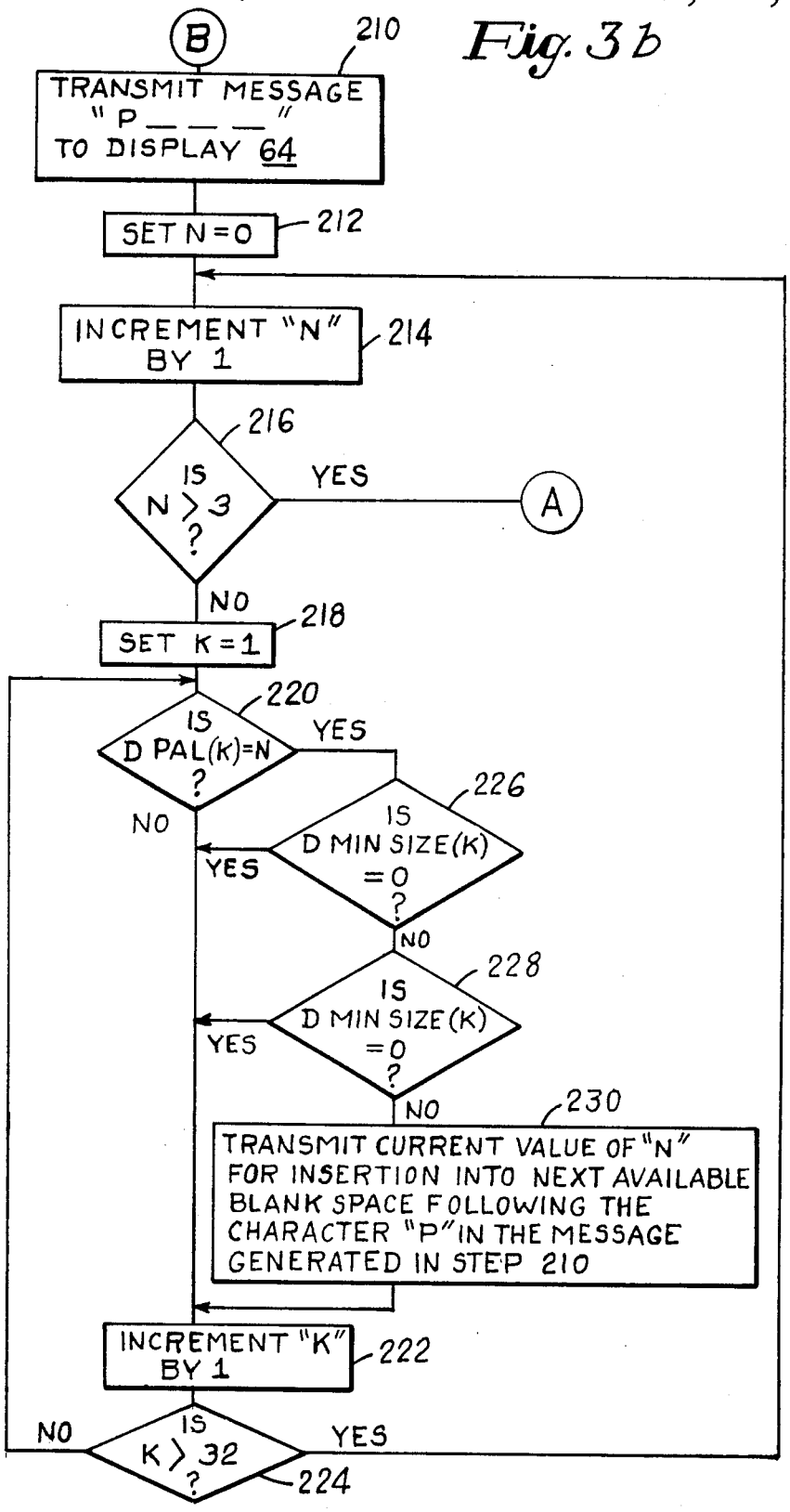

Referring to FIG. 3*b*, the central processor proceeds to execute a number of steps which amount to a survey of directory array information concerning each numbered file stored in the pattern memory 108. The purpose of the survey is to identify whether a file exists for each of the possible numerical pallet codes one, two and three. Each such identified file must moreover have specified minimum and maximum size values for the file. The program logic of FIG. 3*b* hence conducts a first survey of directory information on pallet code values associated with file numbers. The program logic also conducts a survey of directory information having appropriate minimum and maximum size values for indicated file numbers. This program logic begins with a step 210 which transmits the message "P" followed by three blank spaces to the alphanumeric display 64. The central processor now proceeds to set a variable "N" equal to zero in a step 212. The variable "N" will be used to incrementally define the possible numerical values of the pallet codes. In this regard, the variable "N" is set equal to the first possible pallet code numerical value of one in a step 214. As long as the value of "N" is less than three, the central processor will proceed through a step 216 to a step 218 wherein another variable "K" is set equal to one. The variable "K" will be used to define incremental index values within the directory arrays D PAL, D MIN SIZE, and D MAX SIZE. In this regard, the central processor will first of all inquire as to whether the indexed array element within the D PAL array is equal to the current value of "N". If for instance the first array element is not, then the central processor will proceed to a step 222 wherein the index variable "K" is incremented by one. As long as the thus incremented value of the index variable "K" is not greater than thirty two, the central processor will proceed through a step 224 and return to the step 222. Referring now to step 220, when an indexed element within the D PAL array is found to have a value equal to the current value of "N", the central processor proceeds along a yes path to a step 226 and checks for a non zero value of the correspondingly indexed element within the D MIN SIZE array. In the event that there is a non zero minimum size indicated, the central processor proceeds along a no path to a step 228 and inquires as to whether or not the indexed element within the D MAX SIZE array is also non zero. If the answer is again affirmative, the central processor proceeds along a no path to a step 230 and transmits the current value of "N" for insertion into the next available blank space following the character "P" in the message generated in step 210. In this manner, a display appears on the control panel 62 informing the operator that a pallet containing the thus indicated code has at least one stitch pattern file number with appropriate minimum and maximum size parameters. Referring again to steps 226 and 228 in the event that no minimum or maximum size values are found for particularly identified file numbers in step 220, then the central processor proceeds down to the step 222 and increments "K". The central processor will continue to search through the aforementioned directory arrays until the value of "K" exceeds thirty two. At this time, the central processor will exit from step 224 back to step 214 and increment the value of "N" by one. The same process now occurs for the new value of "N" defined by step 214. The central processor will proceed through the step 214 a total of three times until "N" is greater than three in step 216. At this point, the central processor will have surveyed all relevant directory data for the three possible numerical values of the pallet code defined by the sensors 110 and 112. The central processor will now proceed back to node A in FIG. 3*a* at this time.

Referring to FIG. 4, it is to be noted that the particular directory data therein would result in a displayed message of "P123". In other words, the numeral one would be displayed in step 230 as a result of "K" being set equal to one in step 218. Similarly, the numeral two would be displayed as a result of "K" being set equal to three while "N" was set equal to two. Furthermore, the numeral three would be displayed as a result of "N" being set equal to three and "K" being set equal to five.

It is to be noted that the central processor will continue to display the aforementioned complete message as long as no pallet has been inserted into the sewing machine system. In other words, the central processor unit will continue to survey the directory data and display the numerical pallet codes having particular file numbers with maximum and minimum size parameters. When, however, a pallet is appropriately inserted into the system, the sensors 110 and 112 will produce binary values indicative of a particular pallet code.

Referring to FIG. 3*a*, the central processor will read the binary values of the sensors 110 and 112 in a step 204 and invert the values in step 206. The results will be stored in the variable PAL. It is to be appreciated that the inversion in step 206 will result in the following correspondence between the binary values of the optical sensors 110 and 112 versus the stored results in PAL:

| Sensor 110 | Sensor 112 | PAL |
|---|---|---|
| 1 | 0 | 01 |
| 0 | 1 | 10 |
| 0 | 0 | 11 |

The above two bits of stored binary in PAL represent numerical values 1, 2 and 3 in decimal. Accordingly, the stored two bits in PAL will be treated by the program as identifying either a pallet code of 1, 2 or 3. One of the above numerical pallet codes will have been stored in PAL as a result of step 206. The central processor will therefore exit out of step 208 to a node C in FIG. 3*c*.

Figure 3C:
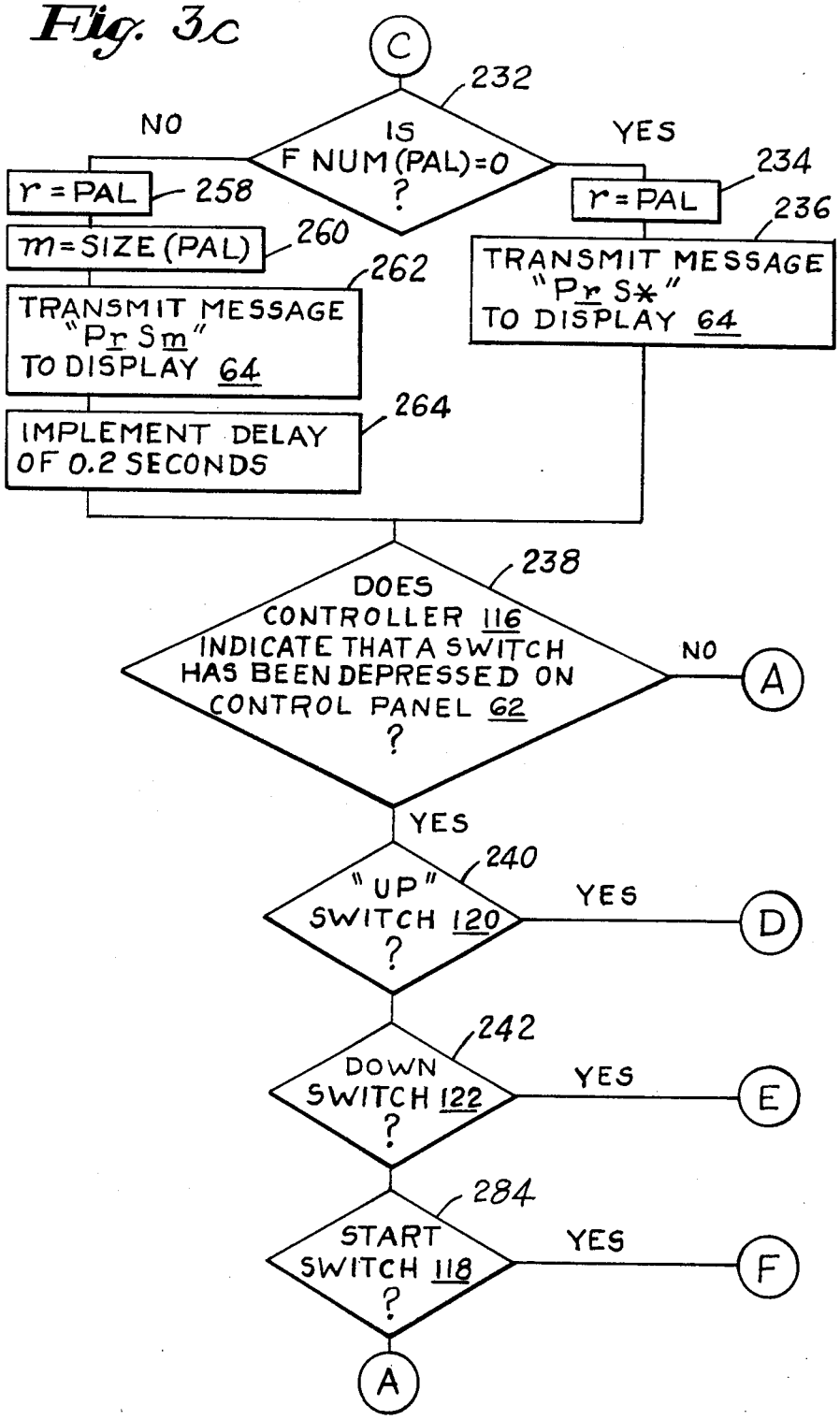

Referring now to FIG. 3*c*, the central processor first inquires as to whether the variable F NUM(PAL) is equal to zero. It will be remembered that all indexed F NUM variables will have been set equal to zero initially in step 202. This will mean that any pallet code sensed for the first time in step 204 will define a particular indexed F NUM variable in step 232 that is equal to zero. This will result in the central processor pursuing the yes path out of step 232 to a step 234. The value of PAL is set equal to "r" in step 234 and this value is transmitted within the message "PrS*" to display 64 in a step 236. This displayed message advises the operator of the machine that the current pallet inserted into the machine bearing the pallet code number displayed in the position occupied by "r" needs a particular stitch pattern file assignment. The remaining program steps in FIG. 3*c* deal with how the operator wishes to choose a particular stitch pattern file. In this regard, the central processor will address the controller 116 in a step 238 and check to see whether a switch has been depressed on the control panel 62. When a particular switch has been depressed, the central processor proceeds to a step 240 and inquires as to whether the panel controller is indicating that the "UP" switch 120 has been depressed. If the operator has depressed the "UP" switch, then the central processor will proceed out of the step 240 to a node D in FIG. 3*d*. On the other hand, if the "DOWN" switch has been depressed, then the central processor will proceed through the step 242 and thereafter proceed to a node E in FIG. 3*e*. It is hence to be appreciated that the operator has two possible choices for making a particular stitch pattern file assignment. These are either a selection through using the "UP" switch 120 or the "DOWN" switch 122. As will be explained in detail hereinafter, selection of either switch results in an interactive communication with the operator allowing a particular assignment to be made. This interactive system will include the display of size information which will allow the operator to make the assignment based on his or her knowledge of the workpiece size within the pallet that has been loaded on the shelves 16 and 18 in FIG. 1.

Figure 3D:
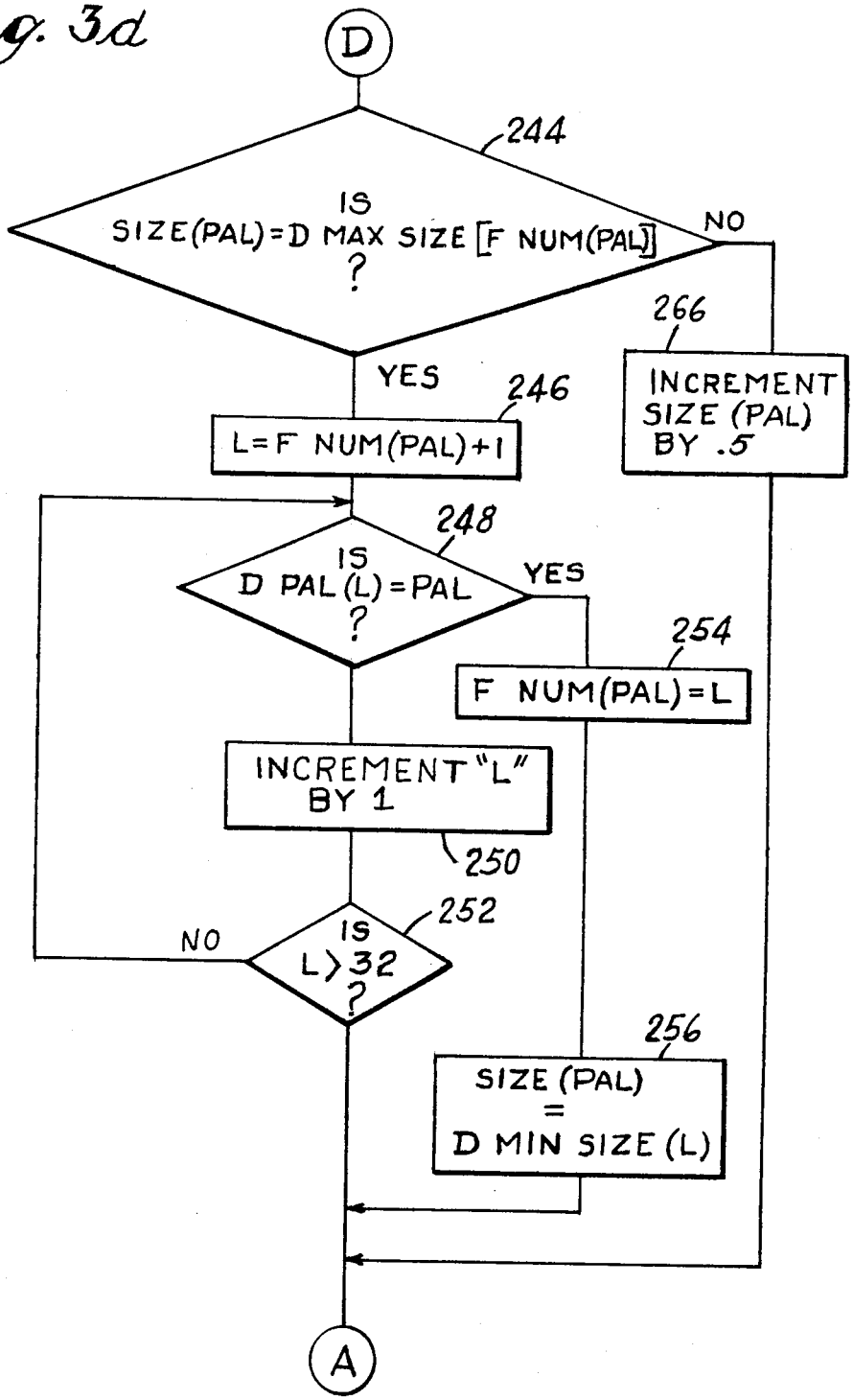

Referring now to FIG. 3*d*, in the event that the UP switch is depressed, a step 244 will determine whether the value of the particularly indexed variable within the SIZE array (indicated to the left of the equal sign) is equal to the particularly indexed directory array element within the D MAX SIZE array (indicated to the right of the equal sign). Since all indexed SIZE variables are initially equal to zero, the left side of the equivalence statement in step 244 will be zero when a new pallet code is sensed for the first time. Referring now to the right side of the equivalence statement, the particular index for the directory element within the D MAX SIZE array will be determined by the current value of F NUM(PAL). The indexed variable F NUM(PAL) will initially be zero. This produces an index of zero for the D MAX SIZE Directory array. Referring to FIG. 4, all Directory array values for a Directory index of zero will be zero. This means that both sides of the equivalence statement in step 244 will be initially zero when a new pallet code is sensed for the first time. The central processor hence proceeds along a yes path to a step 246 and sets a variable "L" equal to the current value of F NUM(PAL) plus one. In other words, the variable "L" is being used to define an incremented value of F NUM(PAL). This new variable "L" is now used as an index within the D PAL directory array. Referring now to steps 240, 250 and 252, the central processor is comparing the value of each indexed array element within the D PAL array to the current value of PAL. This comparison continues to occur until such time as an equivalence is noted. This will occur within the directory data of FIG. 4 when, for instance, a pallet code of two has been stored in PAL and when "L" is set equal to three. The central processor proceeds to set the indexed array variable F NUM(PAL) equal to the current value of "L" in a step 254. In other words, the central processor has found a file number within the directory data that has a matching pallet code number within the D PAL array. The central processor now proceeds in a step 256 to set the indexed variable defined by PAL within the SIZE variable array equal to the "L" indexed element within the D MIN SIZE array. In this regard, if the pallet code is two, and F NUM(PAL) is set equal to three in step 254, then the SIZE (PAL) variable will be set equal to 8.5 in step 256 for the directory data of FIG. 4. It is hence to be appreciated that the indexed variables F NUM(PAL) and SIZE(PAL) are now defined as other than zero for the first time.

The definitive assignment of a particular file number indicated by "L" and a particular minimum size will allow for further interactive communications with the operator as will now be explained. The central processor proceeds back to node A in FIG. 3*a* following step 256 in FIG. 3*d*. The pallet encoding 52 and 54 remaining in position under the sensor 56 results in the central processor proceeding through step 208 to node C in FIG. 3*c*. At this time, the variable F NUM(PAL) is equal to a non zero value. This results in the central processor proceeding out of step 232 to a step 258 wherein the variable "r" is set equal to the value of PAL. The newly assigned value of the indexed variable SIZE(PAL) is next set equal to the variable "m". The central processor now proceeds to display the newly assigned size information "m" for the particular pallet code stored in "r" in a step 262. A delay of 0.2 seconds is now implemented in a step 264 so as to allow the operator to react to the displayed message of step 262. The delay of 0.2 seconds must be such that the operator has an opportunity to release the "UP" switch 120 if the newly displayed Size "m" is the same as the size of the workpiece within the pallet 10. It is to be appreciated that this delay could, of course, be increased for a slower reaction time by the operator.

In the event that the displayed size does not agree with the size of workpiece that is to be sewn, the operator will continue to depress the "UP" switch so to again cause the central processor to proceed through steps 238 and 240 to node D in FIG. 3*d*. Referring to FIG. 3*d*, the central processor will again determine whether the left side of the equivalence statement is equal to the right side in step 244. Since the left side, namely, SIZE(PAL) has previously been set equal to the minimum size parameter of the currently selected stitch pattern file defined by F NUM(PAL), it should normally not be equal to the maximum size allowable for the same stitch pattern file as defined by the right side of the equivalence statement. This will result in the central processor pursuing the no path out of step 244 to a step 266 wherein the current value stored in SIZE(PAL) is incremented by 0.5. The central processor will proceed through node A to node C and hence to step 260 wherein the newly incremented value in the SIZE(PAL) variable will be set equal to "m". This newly incremented size value will thereafter be displayed in step 262 and the operator will again be allowed the opportunity to respond to the newly displayed size information. It is to be noted that the central processor will continue to exit through to node D in FIG. 3*d* until such time as the operator decides that the appropriately displayed size information is in agreement with the size of the workpiece that is to be sewn. This may require the successive displaying of all possible sizes for a given stitch pattern file so as to thereby cause the value stored in SIZE(PAL) to be equal to the maximum size allowable for the particular stitch pattern file. When this occurs, the central processor will proceed out of step 244 in FIG. 3*d* to step 246 and add one to the current file number stored in F NUM(PAL). The central processor will now begin a search of further D PAL array data until another indexed array element value is found to be equal to the current value of PAL. The index "L" for this array element will be stored in F NUM(PAL) in step 254. The SIZE(PAL) variable will now be set equal to the corresponding minimum size parameter within the D MIN SIZE array in step 256. The newly assigned SIZE(PAL) value will be displayed in step 262 and thereafter further incremented in step 266 until such time as the operator releases the "UP" switch 120 thereby signifying agreement with the currently displayed size information. In this manner, the operator can continue to interact with the display 64 until such time as an appropriate size has been selected. During this time, the programmed central processor unit may have gone through several stitch pattern files which could have been executed for other sizes of work held with a pallet having the given pallet code sensed by the sensors 110 and 112. Each time the central processor moves to the next stitch pattern file number, the displayed sizes will moreover have increased over the previously displayed sizes. This will occur if the size ranges are preferably arranged in ascending order as illustrated in FIG. 4. In this manner, the operator has been able to select the appropriate stitch pattern file from among a number of possible stitch pattern files by simply reacting to displayed size information in step 262.

Figure 3E:
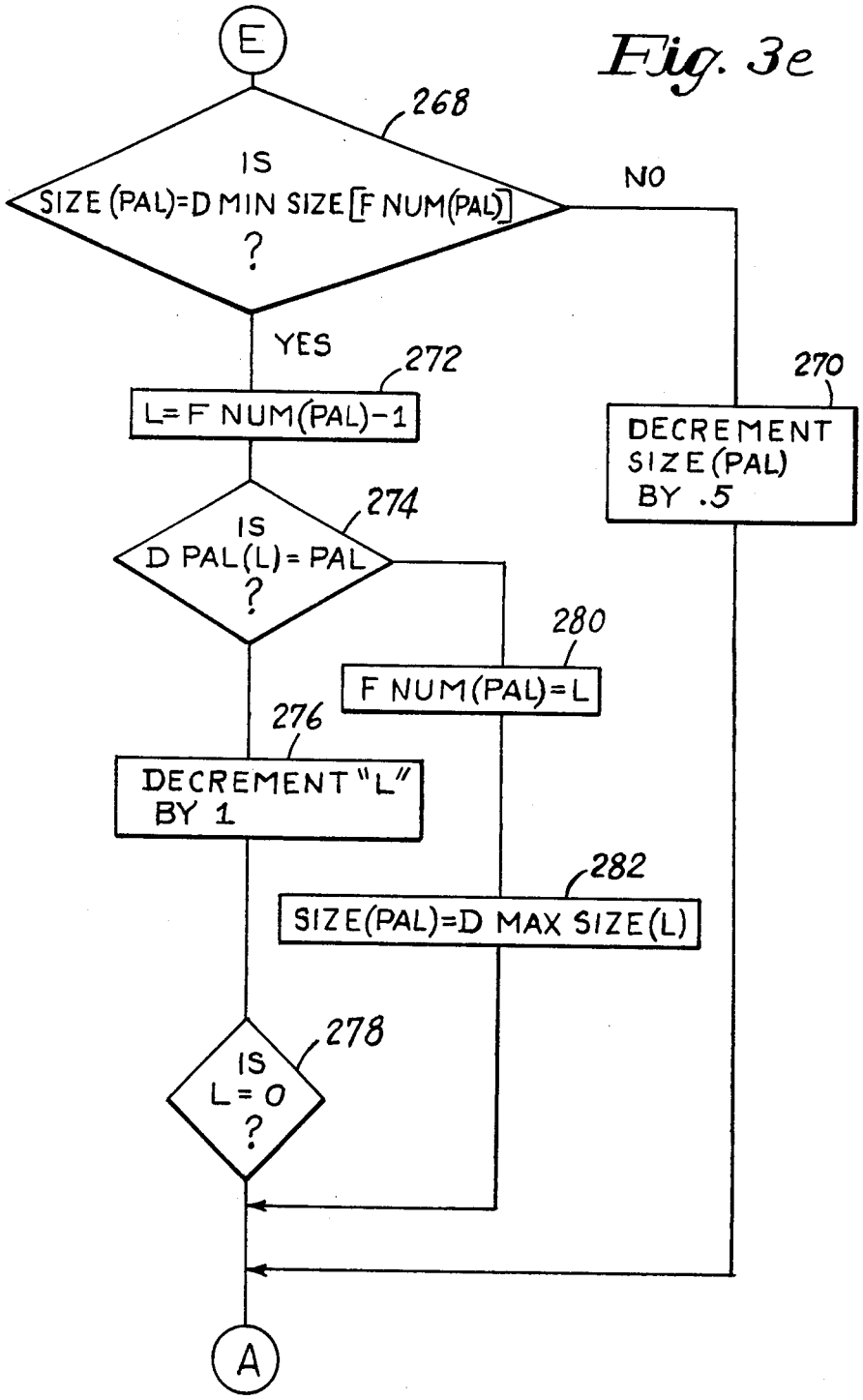

Referring again to FIG. 3*c*, it is to be noted that the operator may at any time, during the display of messages, decide to press the "DOWN" switch 122. This will cause the central processor to proceed to step 242 and hence to a node "E" in FIG. 3*e*. Referring now to FIG. 3*e*, a step 268 determines whether the value of the particularly indexed variable SIZE(PAL) is equal to the particularly indexed directory array element D MIN SIZE shown to the right of the equal sign. The particular numerical index for the SIZE(PAL) variable will, of course, be determined by the value of PAL. The particular value of this indexed variable is compared with the value of the D MIN SIZE array element identified by the directory index of F NUM(PAL). This essentially means that the minimum size parameter for the currently identified file number is to be compared with the value of SIZE(PAL). The value of SIZE(PAL) is, of course, the currently displayed size in step 262. As long as the currently displayed size exceeds the minimum size parameter for the indicated file number, the central processor will proceed along a no path and decrement the value stored in SIZE(PAL) in a step 270. In other words, the "DOWN" button will authorize a downward decrementing of the displayed size in step 262. This decremented size will thereafter be displayed in step 262 and the operator will be afforded an opportunity to release the "DOWN" switch 122 or continue the downward decrementing of sizes in step 270. This will continue to occur for the particular file number defined by F NUM(PAL) until such time as the minimum size is reached. At this point, the central processor proceeds from the step 268 to a step 272 and decreases the current value stored in F NUM(PAL). This is accomplished by again using the variable "L". This variable is used to define successively downwardly incremented directory index values until such time as an indexed element within the D PAL array is found to be equal to the current value of the pallet code stored in the variable PAL. This is determined in steps 274, 276 and 278. When a particular indexed element within the D (PAL) array has been found to be equal to the current value of the pallet code, the central processor will proceed in a step 282 to set the F NUM(PAL) variable equal to the current value of "L". The central processor will thereafter set the SIZE(PAL) variable equal to the value of the array element within the D MAX SIZE array defined by the array index of "L". This newly defined size will be displayed in step 262 so as to allow the operator to respond by continuing to depress the "DOWN" switch or to signify acceptance with the thus displayed size information. In this manner, the "DOWN" switch 122 can be used in much the same manner as the "UP" switch 120 so as to allow the operator to select an appropriate size matching to the size of the workpiece within the particular coded pallet presented to the system. This is done without precise knowledge on the part of the operator as to which file must be selected from the pattern memory 108.

Referring to FIG. 3*c*, when the displayed size in step 262 is accepted, the operator releases either the "UP" switch 120 or the "DOWN" switch 122 so as to no longer cause the panel controller to indicate that a switch has been depressed on the control panel 62. The central processor will now await a further communication from the operator. Specifically, the central processor will loop through step 238 back to node A of FIG. 3*a* until the operator has further elected to depress yet another switch on the control panel 62. At this time, the central processor will again check as to whether the "UP" or "DOWN" switches have been depressed in steps 240 and 242 and then proceed to check as to whether the START switch 118 has been depressed in a step 284. It is to be noted that if the START switch has not been depressed, then the central processor again returns to node A and awaits a further meaningful communication to be analyzed by step 238.

Figure 3F:
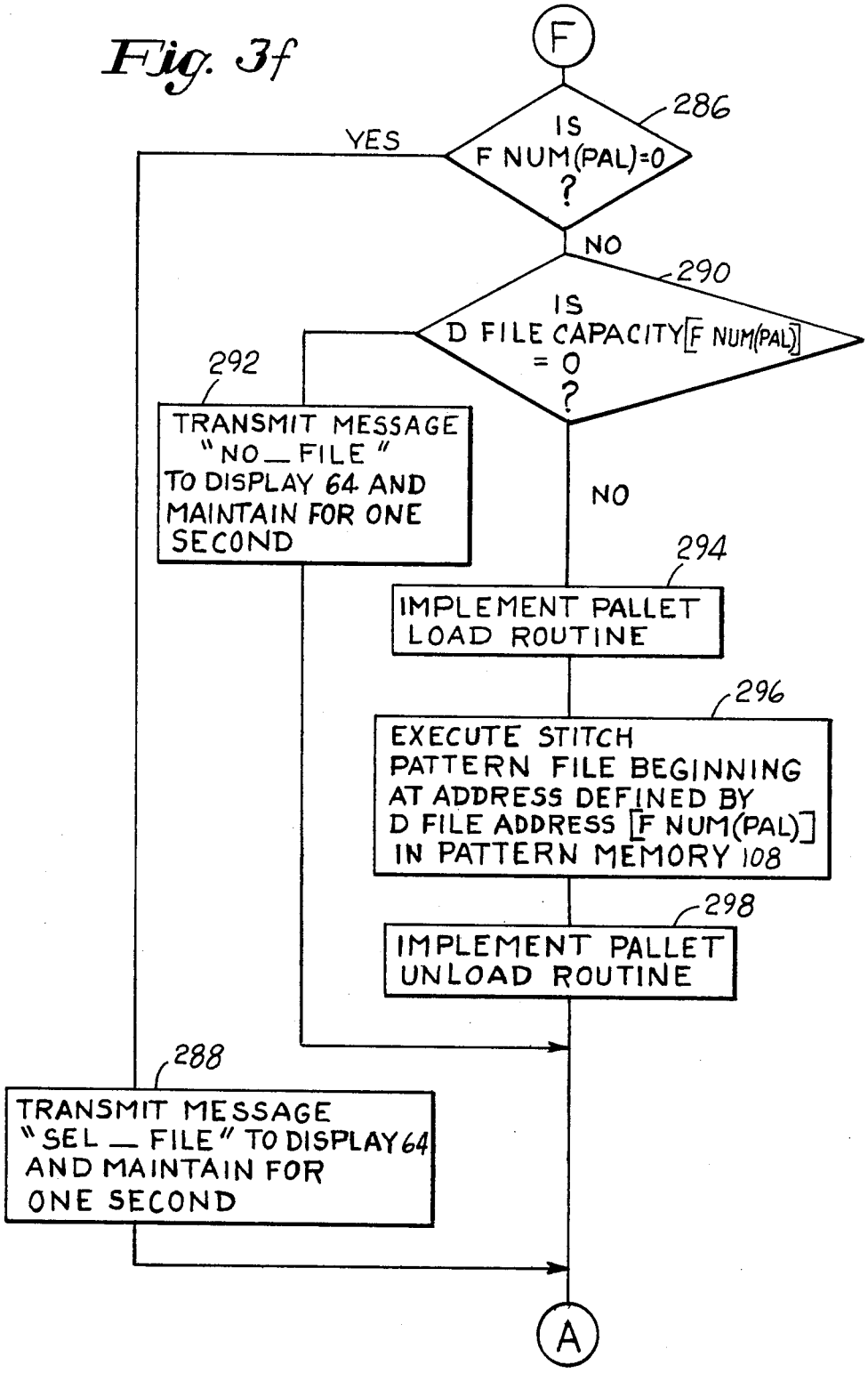

In the event that the START switch has been depressed, the central processor will proceed out of step 284 along a yes path to node F in FIG. 3*f*. Referring to FIG. 3*f*, this portion of the program attempts to execute a particular stitch pattern that has been selected by the operator through the aforementioned size selection process. In this regard, the central processor begins by checking as to whether the variable F NUM(PAL) equals zero. It is to be noted that this is merely a check to see whether the operator has inadvertently pressed the START switch 118 before selecting a size and hence a particular stitch pattern file. In the event that this has occurred, the central processor proceeds out of step 286 along a yes path to a step 288 and transmits a message to the display 64. This message asks the operator to select a file. The central processor returns to node A in FIG. 3*a* wherein the pallet code is again sensed and the message "PrS*" is eventually displayed in a step 236. The operator will hence have been advised that he must select a size through either the "UP" or "DOWN" switch before attempting to start the sewing machine system.

Referring again to FIG. 3*f*, in the event that a stitch pattern file has been appropriately assigned through selecting an appropriate size, the variable F NUM(PAL) will be other than zero allowing the central processor to proceed to a step 290 when the START switch has been depressed. Referring to step 290, the central processor asks whether the array element within the D FILE CAPACITY array identified by the directory index of the current value of F NUM(PAL) is equal to zero. Referring to FIG. 4, the indexed elements within the D FILE CAPACITY array indicate whether in fact there are any storage locations within the pattern memory 108 containing stitch pattern data for the numbered file. In the event that a previously selected file does not in fact have any stitch pattern data stored within the pattern memory, then the D FILE CAPACITY will be zero. This is, in fact, illustrated for a directory index of four in FIG. 4. If this has occurred, the central processor will proceed out of step 290 in FIG. 3*f* and transmit a message "NO FILE" in a step 292. The central processor will proceed back to node A in FIG. 3*a* and again wait for a further response from the operator via step 238.

Referring again to FIG. 3*f*, in the event that the file defined by F NUM(PAL) does in fact have addressable storage locations within the pattern memory 108, the central processor proceeds to a step 294 and implements a pallet load routine. This routine may process the pallet from a location above the sewing area (such as defined by the shelves 16 and 18) to a location where attachment can occur with the moveable carriage 24. Following attachment of the pallet 10 to the moveable carriage 24, the central processor will proceed to a step 296 in FIG. 3*f*. Referring to step 296, the stitch pattern file is identified within the pattern memory 108 by the appropriately indexed element within the D FILE ADDRESS array. The directory index is defined by the value of F NUM(PAL). This latter value is, of course, the assigned file number for the pallet code identified by PAL. The workpiece within the pallet 10 will hence be positioned relative to the reciprocating sewing needle 28 in response to the addressing and execution of the stitch pattern file in step 296. Following completion of the sewing, the central processor will proceed to a step 298 and implement a pallet unload routine. The unloading of a pallet following the completion of sewing has been previously discussed relative to FIG. 1. In this regard, a pallet will be dropped from the moveable carriage 24 as long as a switch 50 indicates that the slides 42 and 44 can accept the dropped pallet. When a pallet has been thus dropped, the central processor will proceed to node A in FIG. 3*a* and sense any further pallet code that may have been presented to the sensor 56. The central processor will proceed to note whether the sensed pallet code has had a stitch pattern file previously assigned thereto and either await such an assignment or an authorization to further process the thus loaded pallet. The assignment will, of course, occur through an appropriate selection of displayed sizes as has been previously discussed. The authorization to proceed will occur when the operator presses the START switch 118. The pallet will be dropped to the sewing location and attached to the movable carriage 24 so that the assigned stitch pattern may thereafter be sewn. This pallet will, of course, not be dropped to the slides 42 and 44 until the previous pallet has been removed.

It is to be appreciated from the above that a sewing machine system has been disclosed wherein the operator may select appropriate stitch patterns to be sewn on workpieces located within pallets that are to be automatically processed within the system. The operator's selection of an appropriate stitch pattern is accomplished without any knowledge or understanding of the actual stitch patterns stored within the pattern memory 108. In this regard, the operator need only know the size of the workpiece that is to be sewn.

It is to be appreciated that the aforementioned system has been disclosed in a particular preferred embodiment. It is to be understood, however, that various portions of this system may be changed or altered without departing from the scope of the invention. For example, the processing of pallets could be further automated so as to not require activation of the START switch each and every time a pallet is to be dropped from the input location to the sewing location. This is taught in U.S. Pat. No. 4,479,466 which includes automatic processing in the event that a stitch pattern has been previously assigned.

It is also to be appreciated that the processing of the pallets from an input location to a sewing location and hence to an output location need not be present in order for a pallet to be sensed and a size selection made prior to sewing a particular workpiece. For instance, a pallet code could be sensed while the pallet was simply being manually attached to a positioning system. The operator of the machine could make an appropriate assignment of a stitch pattern based on size selection prior to authorizing the automatic positioning of such an attached pallet containing a workpiece.

It is still further to be appreciated that alternative logic within the system may be used without departing from the scope of the present invention. In this regard, a particular programmed process has been disclosed relative to particularly defined directory information and certain variables. The programmed process, directory information and variables could be changed without departing from the scope of the present invention.

What is claimed:

1. A sewing machine wherein stitch patterns are automatically sewn on workpieces prearranged within pallets having associated pallet codes, said machine including a system for selectively assigning the stitch patterns to the pallet codes comprising:

means for sensing the pallet codes associated with the pallets;

means, responsive to a particular pallet code having been sensed by said sensing means, for displaying size information relative to stitch patterns stored within the system; and means for selecting a stitch pattern to be sewn from the displayed size information.

2. The sewing machine of claim 1 wherein said means for selecting a stitch pattern to be sewn comprises:

means for selectively enabling said means for displaying size information whereby size information is incrementally displayed until such time as an acceptable size is displayed; and means for assigning the stitch pattern corresponding to the acceptable displayed size to the sensed pallet code.

3. The sewing machine of claim 1 wherein said means for selecting a stitch pattern to be sewn from the displayed size information comprises:

means for selecting a size from the displayed size information; and means for assigning a stitch pattern corresponding to the selected size to the sensed pallet code.

4. The sewing machine of claim 3 wherein said means for assigning a stitch pattern corresponding to the selected size comprises:

means for storing an identification of the stitch pattern corresponding to the selected size in a storage which is recallable each time the particular sensed pallet code is again sensed whereby the identification can be used to thereafter access the stitch pattern from within the system.

5. The sewing machine of claim 3 further comprising:

means for storing the selected size in a storage which is recallable each time the sensed pallet code is again sensed; and means for displaying the stored size for the sensed pallet code when the particular pallet code is again sensed.

6. The sewing machine of claim 5 further comprising:

means for authorizing the accessing of the assigned stitch pattern corresponding to the displayed size unless said means for selecting a size is further activated.

7. The sewing machine of claim 1 wherein said means for displaying size information comprises:

means for identifying each stitch pattern stored within the system which may be used with the particular sensed pallet code; and means for displaying the size range for each identified stitch pattern.

8. The sewing machine of claim 7 wherein said means for selecting a stitch pattern to be sewn from the displayed size information comprises:

means for selecting a size within a particularly displayed size range; and means for assigning the stitch pattern corresponding to the selected size to the sensed pallet code.

9. The sewing machine of claim 8 further comprising:

means for authorizing the accessing of the assigned stitch pattern unless said means for selecting a size is again activated.

10. The sewing machine of claim 8 wherein said means for assigning the stitch pattern corresponding to the selected size comprises:

means for storing an identification of the stitch pattern corresponding to the selected size in a storage which is recallable each time the particular sensed pallet code is again sensed whereby the identification can be used to thereafter access the stored stitch pattern.

11. The sewing machine of claim 8 further comprising:

means for storing the selected size in a storage which is recallable each time the sensed pallet code is again sensed; and means for displaying the stored size for the sensed pallet code when the particular pallet code is again sensed.

12. The system of claim 11 further comprising:

means for authorizing the accessing of the assigned stitch pattern corresponding to the selected size unless said means for selecting sizes has been selectively activated.

13. The sewing machine of claim 1 wherein said means for displaying size information comprises:

means for identifying each stitch pattern stored within the system which may be used with the particular sensed pallet code; and means for incrementally displaying sizes of workpieces which may have a given identified stitch pattern sewn thereon.

14. The sewing machine of claim 13 wherein said means for incrementally displaying sizes of workpieces comprises:

means for initially defining a limit to the range of sizes for the given identified stitch pattern whereby the size limit is used as an initial size for display.

15. The system of claim 14 wherein said means for incrementally displaying sizes of workpieces comprises:

means for defining a second limit to the range of sizes for the given identified stitch pattern; and means for advancing to the next identified stitch pattern which may be used with the particular sensed pallet code following display of the second limit for the given identified stitch pattern.

16. The system of claim 1 further comprising:

means, responsive to no pallet code having been sensed, for searching a database of information for possible stitch patterns that may be selected for each possible pallet code; and means for displaying those pallet codes which have at least one stitch pattern that may be selected.

17. A system for selecting stitch patterns which are to be automatically sewn on workpieces of varying sizes that are presented to a sewing machine, said system comprising:

means for displaying size information for stitch patterns which may be automatically sewn by the sewing machine;

means for selecting a particularly displayed size for a given size of workpiece that is to be automatically sewn; and means, responsive to a selection of a particularly displayed size, for accessing a particular stitch pattern that is to be sewn on a given size of workpiece.

18. The system of claim 17 wherein said means for displaying size information comprises:

means for identifying a range of sizes for each stitch pattern which may be automatically sewn by the sewing machine; and means for displaying each identified range of sizes for each stitch pattern.

19. The system of claim 18 wherein said selecting means comprises:

means for selecting a size within a particularly identified range of sizes for a given stitch pattern.

20. The system of claim 19 wherein said means for accessing the stitch pattern that is to be sewn comprises:

means for storing an identification of the given stitch pattern in a recallable storage; and means for automatically accessing the given stitch pattern utilizing the stored identification.

21. The system of claim 19 further comprising:

means for storing the selected size in a recallable storage; and means for displaying the selected size prior to accessing the given stitch pattern each time it is to be sewn.

22. The system of claim 19 wherein said means for selecting a size within a particularly identified range of sizes for a given stitch pattern comprises:

means for initially defining a limit to the range of sizes for the given stitch pattern;

means for incrementing sizes which are to be displayed beginning with the initially defined limit; and means for stopping said means for incrementing sizes when the selected size is displayed.

23. The system of claim 18 wherein said means for displaying each identified range of sizes for each stitch pattern comprises:

means for sequentially displaying each size within an identified range of sizes; and means for advancing to the next identified range of sizes if a size has not been selected following the display of a size limit for the identified range of sizes.

24. The system of claim 17 wherein said means for displaying size information comprises:

means for displaying a range of sizes for each stitch pattern which may be automatically sewn by the sewing machine.

25. The system of claim 24 wherein said means for accessing the stitch pattern stored within the system that is to be sewn on the given size of workpiece comprises:

means for storing an identification of the stitch pattern corresponding to the range of sizes from which a particularly displayed size has been selected; and means for accessing the stitch pattern utilizing the stored identification of the stitch pattern.

26. The system of claim 17 further comprising:

means for storing the selected size in recallable storage; and means for displaying the stored size each time a workpiece of the given size is to be automatically sewn.

27. The system of claim 26 further comprising:

means for authorizing the accessing of the stitch pattern unless said means for selecting a size is again activated.

28. A sewing machine wherein stitch patterns are automatically sewn on workpieces prearranged within pallets having associated pallet codes, said machine comprising:

means for sensing the pallet codes associated with the pallets;

means, responsive to a particular pallet code having been sensed by said sensing means, for displaying size information relative to a stitch pattern that has been assigned to the particular pallet code; and means for accessing the assigned stitch pattern following the display of the size information.

29. The sewing machine of claim 28 wherein said means for accessing the assigned stitch pattern following the display of the size information comprises:

means for recalling a stored stitch pattern identification in response to sensing the particular pallet code; and means for utilizing the stored stitch pattern identification when accessing the assigned stitch pattern.

30. The sewing machine of claim 29 wherein said means for utilziing the stored stitch pattern identification when accessing the assigned stitch pattern comprises:

means for identifying the storage location of the stitch pattern within a memory utilizing the stored stitch pattern identification.

31. The sewing machine of claim 28 wherein said means for displaying size information relative to a stitch pattern that has been assigned to the particular pallet code comprises:

means for displaying the range of workpiece sizes which may be sewn by the assigned stitch pattern.

* * * * *